US007786944B2

(12) United States Patent
Franson et al.

(10) Patent No.: US 7,786,944 B2
(45) Date of Patent: Aug. 31, 2010

(54) HIGH FREQUENCY COMMUNICATION DEVICE ON MULTILAYERED SUBSTRATE

(75) Inventors: Steven J. Franson, Scottsdale, AZ (US); Bruce Bosco, Phoenix, AZ (US)

(73) Assignee: Motorola, Inc., Schaumburg, IL (US)

( * ) Notice: Subject to any disclaimer, the term of this patent is extended or adjusted under 35 U.S.C. 154(b) by 333 days.

(21) Appl. No.: 11/923,873

(22) Filed: Oct. 25, 2007

(65) Prior Publication Data

US 2009/0109109 A1 Apr. 30, 2009

(51) Int. Cl.
*H01Q 13/10* (2006.01)

(52) U.S. Cl. ..... 343/770; 343/700 MS

(58) Field of Classification Search ..... 343/770, 343/700 MS, 767
See application file for complete search history.

(56) References Cited

U.S. PATENT DOCUMENTS

| | | | | |
|---|---|---|---|---|
| 4,575,700 | A | 3/1986 | Dalman | |
| 6,023,209 | A | 2/2000 | Faulkner et al. | |
| 6,552,691 | B2 * | 4/2003 | Mohuchy et al. | 343/770 |
| 6,975,275 | B2 | 12/2005 | Choi | |
| 7,050,013 | B2 * | 5/2006 | Kim et al. | 343/770 |
| 2004/0196190 | A1 | 10/2004 | Mendolia et al. | |
| 2005/0190587 | A1 | 9/2005 | Greeff | |
| 2005/0219126 | A1 * | 10/2005 | Rebeiz et al. | 343/700 MS |
| 2006/0055613 | A1 * | 3/2006 | Angelucci | 343/770 |
| 2006/0066495 | A1 | 3/2006 | Isoifovich et al. | |
| 2006/0103577 | A1 | 5/2006 | Lee | |
| 2006/0109192 | A1 | 5/2006 | Weigand | |
| 2006/0131611 | A1 | 6/2006 | Kaluzni et al. | |
| 2006/0131755 | A1 | 6/2006 | Japp et al. | |
| 2006/0139223 | A1 | 6/2006 | Li et al. | |
| 2006/0164310 | A1 | 7/2006 | Verterinen | |
| 2007/0195004 | A1 * | 8/2007 | Rebeiz et al. | 343/876 |

OTHER PUBLICATIONS

Aguilar, J.R., et al,. The Microwave and RF Characteristics of FR4 Substrates, The Institute of Electrical Engineers, 1998.

Leung, L. L., et al., Characterization and Attenuation Mechanism of CMOS-Compatible Micromachined Edge-Suspended Coplanor Waveguides on Low-Resistivity Silicon Substrate, IEEE Transactions on Advanced Packaging, vol. 29, No. 3, Aug. 2006.

(Continued)

*Primary Examiner*—HoangAnh T Le

(57) ABSTRACT

A communication device (110, 210) has an antenna (150, 152, 250, 252) positioned on a multilayer substrate/printed circuit board (154, 254, 254'). A first high frequency material (116, 216) is disposed over a first side of the substrate (154, 254) characterized for low frequency devices. A conductive layer (118, 218) is patterned over the first high frequency material (116, 216), defining first and second circuit traces (122, 124, 222, 224) and first and second antenna traces (132, 134, 232, 234). The first and second antenna traces (132, 134, 232, 234) define a first slot (116, 216) in the first conductive layer (122, 222), which is aligned with a cutout (162, 262) defined by the substrate (154, 254). One of a transmitter (112, 212) and a receiver (114, 214) are disposed over the high frequency material (116, 216) and coupled to the edge emitting antenna (150, 250) by the first and second circuit traces (122, 124, 222, 224). The other of the transmitter (112) and receiver (114) may be positioned on the same or opposed side (aligned or staggered) of the substrate (254) in a similar manner. One or more layers (262), which may be patterned to provide resonant features, are formed between the substrate (254, 254') for isolation.

21 Claims, 3 Drawing Sheets

OTHER PUBLICATIONS

Linardou, I., et al., Twin Vivaldi fed by coplanar waveguide, Electronic Letters, vol. 33, No. 22, Oct. 23, 1997.

Kerekes, Jim, et al., Low VSWR and Insertion Loss over a wide bandwith, MP Digest, Feb. 2006.

Murphy, Stephen, J., et al., Dielectric properties of some PTFE-reinforced thermosetting resin composites, IEEE, Aug. 1989, pp. 263-267.

Kwon, Youngwoo, et al., Low-Loss Micromachined Inverted Overlay CPW Lines with Wide Impedance Ranges and Inherent Airbridge Connection Capability, IEEE Microwave and Wireless Components Letters, vol. 11, No. 2, Feb. 2001., pp. 59-61.

Nikolaou, Symeon, Double Exponentially Tapered Slot Antenna (DETSA) on Liquid Crystal Polymer (LCP) for UWB Applications, Student Paper Contest Finalist in the 2005 IEEE-APS Symposium, pp. 623-626, vol. 2A, Washington, DC, Jul. 2005.

Simons, R.N. et al., New Techniques for Exciting Linearly Tapered Slot Antennas with Coplanar Waveguide, Electronic Letters, vol. 28, No. 7, Mar. 26, 1992.

Transmission Lines, OpenPlatform Retrieved from Internet URL: www.amicon.info/OpenPlatform/index,php/ Transmission_lines, Feb. 2007.

Swanson, Jr., Daniel, G., What's My Impedance, IEEE Microwave Magazine, Dec. 2001.

Leung, L.L., et al., Low-Loss Coplanar Waveguides Interconnects on Low-Resistivity Silicon Substrate, IEEE Transactions on Component and Packaging Technologies, vol. 27, No. 3, Sep. 2004.

Lee, B.T., et al, Conductor Loss Calculation of V-shaped Conductor-Backed Coplanar Waveguides, retrieved from Internet, URL: http://weewave.mer.utexas.edu/MED_files/MED_research/CPW_stuff/V_groove_CPW/V_grv_abstrct.html , Feb. 2007.

Zhang, L., et al, Design and Impementation of System-on-Package for Radio and Mixed-Signal Applications, Proceeding of HDP'04, IEEE 2004.

Panal, S.,et al., Low Cost V-band Filter and Antenna on Liquid Crystal Polymer Substrate, APMC 2005 Proceedings, IEEE.

* cited by examiner

HIGH FREQUENCY COMMUNICATION DEVICE ON MULTILAYERED SUBSTRATE

RELATED APPLICATIONS

This application relates to U.S. application Ser. No. 11/675,152, A High Frequency Coplanar Strip Transmission Line on a Lossy Substrate, filed Feb. 15, 2007.

FIELD

The present invention generally relates to transmission and reception of high frequency signals and more particularly to a communication device having an antenna and/or antennas for transmission and/or reception of high frequency signals on a multilayered substrate typically used for lower frequency devices.

BACKGROUND

Circuits used in many electronic devices, for example, cellular phones and radios, produce, receive, or function with high frequency signals as well as low frequency signals. Integration of high and low frequency circuits typically involve the use of hybrid substrates, with low frequency devices formed on FR4, for example, and high frequency devices formed on RT/Duroid®, for example. Both the low and high frequency signals may be transmitted across a substrate or printed circuit board by metal traces; however, while low frequency signals may be transmitted along a single metal trace, the high frequency signal is typically transmitted by multiple metal traces which form a waveguide structure, such as a microstrip or coplanar trace. The coplanar trace is one in which two or more metal traces are formed on the same surface, thereby guiding an electromagnetic signal between them. These metal traces typically transmit the high frequency signal between circuits such as amplifiers, oscillators, and mixers positioned on a printed circuit board.

Coplanar circuit structures conventionally include coplanar waveguide structures and slotline structures. A coplanar waveguide structure has one or more spaced longitudinal coplanar strip signal conductors positioned between and separated from two longitudinal coplanar ground conductors by respective gap widths, wherein the ground conductors are typically much wider than the gaps. A slotline structure has two spaced longitudinal coplanar conductors having a gap therebetween, wherein the gap is typically much smaller than the lateral width of the conductors.

The metal traces of a coplanar strip transmission line conventionally are formed on a dielectric material, such as a printed circuit board. The high frequency signal exists as an electromagnetic field in the gap between the metal traces. The gap includes the dielectric material as well as air between and above the metal traces. The existence of the electric field in the dielectric material results in undesirable losses in signal strength. This is exacerbated by the electric field naturally concentrating in the higher dielectric constant material over the lower dielectric air.

This loss in signal strength may be reduced by forming the circuitry (both low and high frequency) on a high frequency substrate. For circuit board applications, the loss is reduced by using high frequency substrates such as RT/Duroid® from the Rogers Corp., instead of traditional circuit board material, such as FR4. However, substrates and printed circuit boards typically used for high frequency signals are much more costly than substrates typically used for low frequency signals.

Another known approach to reduce this loss in signal strength is to form a substrate suitable for high frequency devices, e.g., RT/Duroid®, on or over a substrate suitable for low frequency devices, e.g., an FR4 material. High frequency circuitry would be formed on the substrate suitable for high frequency devices and the low frequency circuitry would be formed on the substrate suitable for low frequency devices. However, this approach is still a complicated and costly process.

Furthermore, transmitting and receiving antennas formed on such high frequency substrate materials typically lack sufficient isolation and can be poorly matched if there are any discontinuities.

Accordingly, it is desirable to provide a low cost substrate supporting high frequency circuitry including isolated and matched antennas. Furthermore, other desirable features and characteristics of the present invention will become apparent from the subsequent detailed description and the appended claims, taken in conjunction with the accompanying drawings and this background.

BRIEF DESCRIPTION OF THE DRAWINGS

Embodiments of the present invention will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background or the following detailed description.

As used hereinafter, "substrate" shall refer to either a substrate and/or a printed circuit board; "low frequency substrate" shall refer to a substrate of a material having characteristics favorable for low frequency circuitry (loss characteristics of circuit devices favorable at low frequency), generally referred to as a "lossy" material (at a high frequency), e.g., epoxy resin or FR-4 (flame resistant 4) which is a composite of resin epoxy reinforced with a woven fiberglass mat; and "high frequency material" shall refer to a material having characteristics favorable for high frequency circuitry (loss characteristics of circuit devices favorable at high frequency), e.g., liquid crystal polymer (LCP) and a high frequency foam such as FoamClad$^{R/F}$™ manufactured by Arlon.

High frequency devices, for example, transmitter and receiver modules, are fabricated using existing low cost methods for fabricating lower frequency applications on low cost, low frequency substrates. Standard circuit board manufacturing techniques with minimal post-processing steps enhance performance at a lower cost. Slots, which may also be called gaps, are defined between conductive, e.g., metal, traces carrying a high frequency signal in the range of 2 to 100 gigahertz (GHz). Edge emitting antennas, having slots in the metal antenna traces and cutouts in the substrate, are coupled to the high frequency devices. In one exemplary embodiment, the high frequency devices may be deposed on opposed sides of the substrate, thereby providing isolation, compactness, and lower unit cost. Generally, a thicker high frequency substrate is preferred, because of the detuning/losses from the adjacent FR4 (low frequency substrate), as well as, in some embodiments, providing an increase in distance between antennas resulting in an increased isolation.

The low cost, low frequency substrate, for example FR-4, provides mechanical support for the high frequency circuitry. A high frequency material, for example liquid crystal polymer (LCP), is easily attached to the substrate and contains the high frequency circuitry for easy integration with the low frequency circuitry on the substrate. Selective ground plane placement on or within the substrate allows for end-fire antennas, thereby allowing electromagnetic radiation to emit from the edge of the substrate rather than perpendicular to it. These antennas may be placed on one or both sides of the substrate to provide electromagnetic radiation in a single direction.

Figure 1:
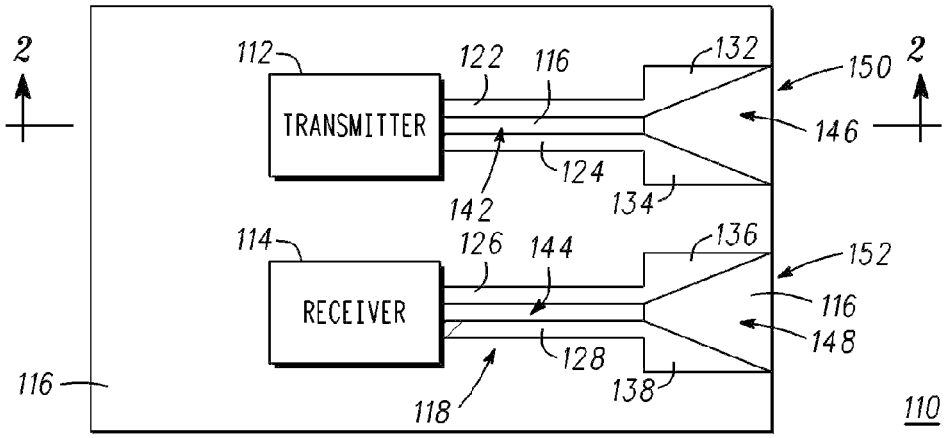
FIG. 1 is a partial block diagram and partial schematic top view of circuitry of a first exemplary embodiment.

Referring to FIG. 1, a partial cross section and block diagram of an exemplary embodiment includes a communication device 110 having a transmitter 112 and a receiver 114 disposed on a layer 116 of material characterized for high frequency devices, for example, liquid crystal polymer (LCP). The transmitter 112 and receiver 114, collectively referred to as a transceiver, typically include for example baseband circuits, a filter, a detector, a mixer, a local oscillator, an amplifier, and a low noise amplifier (none shown) as is known in the industry. A patterned conductive layer 118 includes circuit traces 122, 124, 126, 128 and antenna traces 132, 134, 136, 138. The term "trace" is well known in the industry and is meant to be a conductive line. These circuit traces 122, 124, 126, 128 and antenna traces 132, 134, 136, 138 may be formed on a first surface (or side) of the layer 116 by selectively introducing or removing various materials. The patterns that define such traces may be created by lithographic processes. For example, a layer of photoresist material is applied onto a layer overlying the substrate. A photomask (containing clear and opaque areas) is used to selectively expose this photoresist material by a form of radiation, such as ultraviolet light, electrons, or x-rays. Either the photoresist material exposed to the radiation, or that not exposed to the radiation, is removed by the application of a developer. An etch may then be applied to the layer not protected by the remaining resist, and when the resist is removed, the layer overlying the substrate is patterned. Alternatively, an additive process could also be used, e.g., building a structure using the photoresist as a template. Yet another method of forming the circuit traces 122, 124, 126, 128 and antenna traces 132, 134, 136, 138 may be by ink jet printing. The traces are spatially positioned on the layer 116 wherein the width, or distance between adjacent circuit traces 122, 124, 126, 128, preferably is in the range of 25 to 500 microns.

Circuit traces 122 and 124 define a slot 142 therebetween, and circuit traces 126 and 128 define a slot 144 therebetween. Antenna traces 132 and 134 define a slot 146 therebetween as an antenna 150, and antenna traces 136 and 138 define a slot 148 therebetween as an antenna 152. Circuit trace 122 is connected to antenna trace 132 and circuit trace 124 is connected to antenna trace 134 so that slots 142 and 146 are aligned for transmission of an RF signal from the transmitter 112 to the edge of the device 110. Likewise, circuit trace 126 is connected to antenna trace 136 and circuit trace 128 is connected to antenna trace 138 so that slots 144 and 148 are aligned for transmission of an RF signal to the receiver 114 from the antenna 152 at the edge of the device 110. An exemplary embodiment may include only one of the transmitter 112 and receiver 114 and one of the antennas 150 and 152 respectively coupled thereto.

Figure 2:
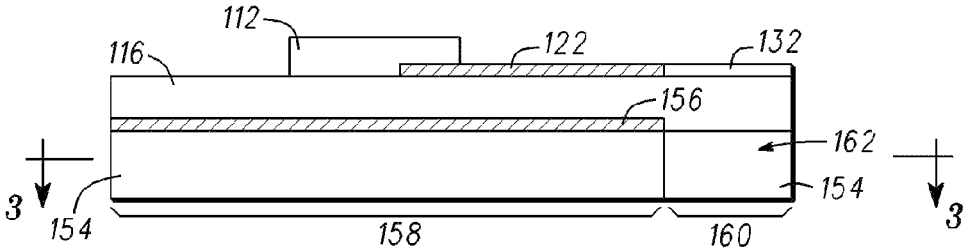
FIG. 2 is a partial cross-sectional view taken along line 2-2 of FIG. 1.

FIG. 2 is a cross sectional view taken along line 2-2 of FIG. 1. The layer 116 is positioned on a substrate 154. The substrate 154 preferably comprises a printed circuit board made of FR4 (flame resistant 4) material, but may comprise any material, such as epoxy resin, that comprises a lossy material. FR4 material is a composite of resin epoxy reinforced with a woven fiberglass mat and is more economical, absorbs less moisture, has great strength and stiffness and is highly flame resistant. For these reasons, FR4 material is widely used for printed circuit boards for low frequency devices. FR4 material previously has been thought to have an upper frequency limit of around 10.0 GHz. A ground plane 156 is formed on a first portion 158 of the substrate 154. A second portion 160 of the substrate 154, minus the ground plane 156, underlies the antennas 150 and 152.

Figure 3:
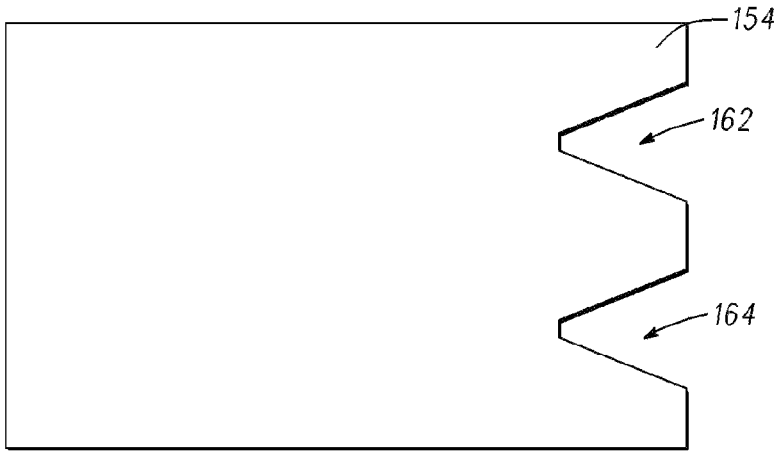
FIG. 3 is a partial top view taken along line 3-3 of FIG. 2.

FIG. 3 is a view of the substrate 154 including the cutouts 162, 164 as taken along the line 3-3 of FIG. 2. Cutouts 162 and 164 are formed in the substrate 154 in line with the slots 146 and 148, respectively. The cutouts 162 and 164 may be created by mechanical drilling, laser burning, or any method of forming a slot in the substrate 154 known in the industry. Alternatively, the cutouts 162, 164 may be formed prior to the patterned conductive layer 118 being formed. The cutouts 162, 164 may vary in shape and dimension from the slots 146, 148.

Figure 4:
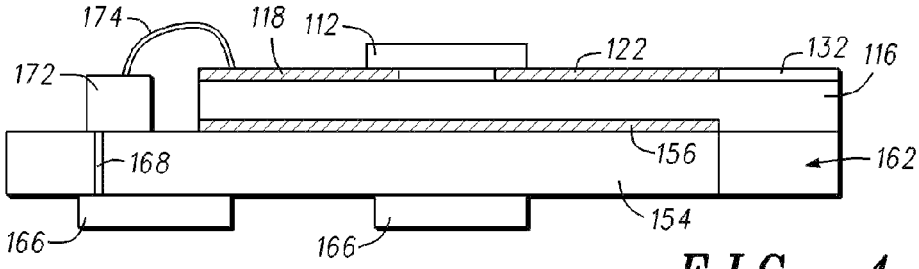
FIG. 4 is a partial cross-sectional view of a second exemplary embodiment.

FIG. 4 further shows how low frequency circuitry 166, including DC circuitry, may be disposed on a side of the substrate 154 opposed to the high frequency circuitry (transmitter 112 and receiver 114), providing isolation therebetween. The low frequency circuitry 166 may be coupled to the high frequency circuitry 172, for example by vias 168 formed within the substrate 154. The high frequency circuitry 172 may be coupled to the patterned conductive layer 118 by, for example, a wire bond 174.

Figure 5:
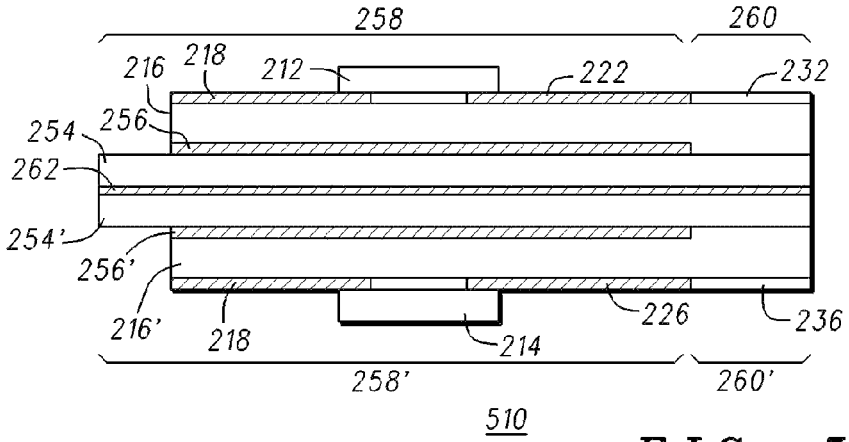
FIG. 5 is a partial cross-sectional view of a third exemplary embodiment.
Figure 6:
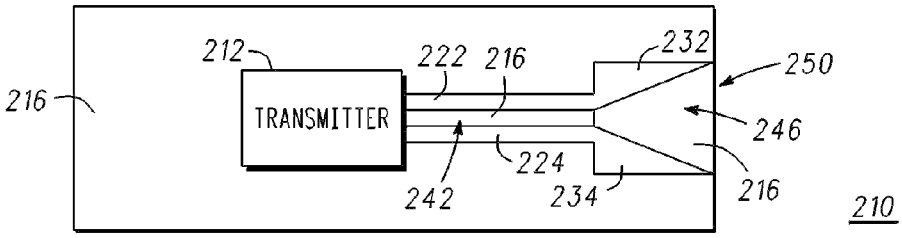
FIG. 6 is a top view of the third exemplary embodiment of FIG. 5.
Figure 7:
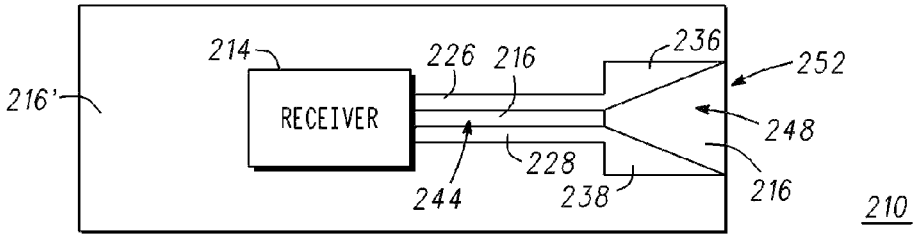
FIG. 7 is a bottom view of the third exemplary embodiment of FIG. 5

FIG. 5 is a cross section of another embodiment of a communication device 510 having a transmitter 212 and a receiver 214 positioned on opposed sides of a substrate 254. FIGS. 6 and 7 are top and bottom views, respectively, of FIG. 5 when the transmitter 212 and receiver 214 are aligned. The communication device 210 has the transmitter 212 disposed on a layer 216 of high frequency material, for example, liquid crystal polymer (LCP). A patterned conductive layer 218 includes circuit traces 222, 224 and antenna traces 232, 234.

Circuit traces 222 and 224 define a slot 242 therebetween. Antenna traces 232 and 234 define a slot 246 therebetween as an antenna 250. Circuit trace 222 is connected to antenna trace 232 and circuit trace 224 is connected to antenna trace 234 so that slots 242 and 246 are aligned for transmission of an RF signal from the transmitter 212 to the edge of the device 210. A ground plane 256 is formed on a first portion 258 of the substrate 254. A second portion 260 of the substrate 254, minus the ground plane 256, underlies the antennas 250.

In a similar manner, a receiver 214 is disposed on a layer 216' of high frequency material, for example, liquid crystal polymer (LCP). A patterned conductive layer 218' includes circuit traces 226, 228 and antenna traces 236, 238. Circuit traces 226 and 228 define a slot 244 therebetween. Antenna traces 236 and 238 define a slot 248 therebetween as an antenna 252. Circuit trace 226 is connected to antenna trace 236 and circuit trace 228 is connected to antenna trace 238 so that slots 244 and 248 are aligned for transmission of an RF signal to the receiver 214 from the edge of the device 210. A ground plane 256' is formed on a first portion 258' of the substrate 254'. A second portion 260' of the substrate 254', minus the ground plane 256', underlies the antennas 250'.

Additional isolation optionally may be provided by forming a layer 262 between the substrates 254 and 254'. It should be noted that substrates 254 and 254' may comprise a unitary substrate, having the layer 262 formed within. The layer 262 may comprise a plurality of layers, optionally coupled by vias. Furthermore, the layer 262 may be patterned to provide resonant features to provide resonant features which may help to increase loss in layers 254, 254', thereby increasing isolation between the antennas.

Figure 8:
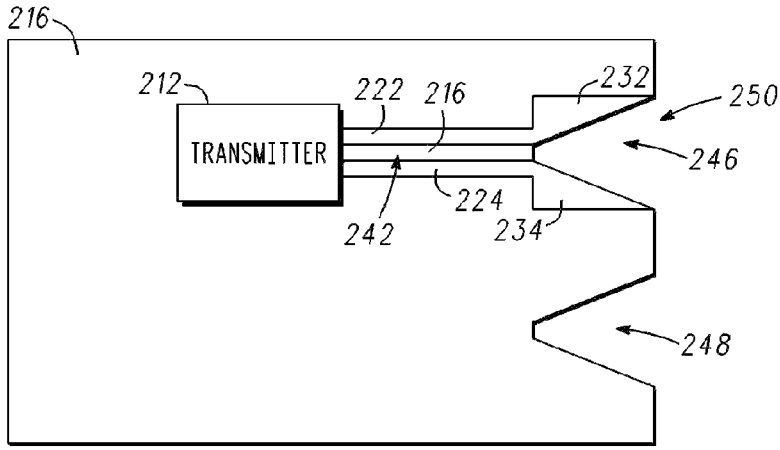
FIG. 8 is a top view of a fourth exemplary embodiment.
Figure 9:
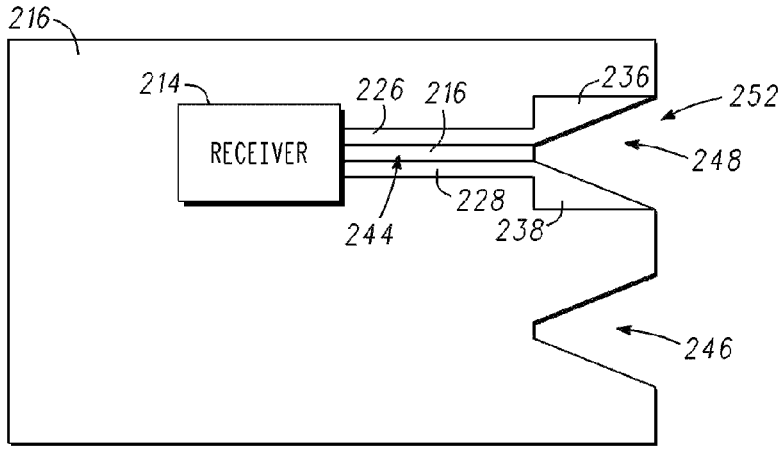
FIG. 9 is a bottom view of the fourth exemplary embodiment.

FIGS. 8 and 9 are top and bottom views, respectively, of FIG. 5 when the transmitter 212 and receiver 214 are staggered. As in the previous exemplary embodiment, antenna traces 232 and 234 define a slot 246 therebetween as an antenna 250 and antenna traces 236 and 238 define a slot 248 therebetween as an antenna 252. This exemplary embodiment shows the layer 216 removed from the cutouts in the substrate adjacent the slots 246 and 248. For horizontal isolation, vertical vias (not shown) may be coupled between layer 262 and the ground planes 256, 256', or may be coupled between layer 262 and the patterned conductive layers 218, 218'.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims.

The invention claimed is:

1. A communication device including:

a substrate characterized for low frequency devices;

a first material characterized for high frequency devices positioned over a first side of the substrate;

a first conductive layer patterned over the first material and defining first and second circuit traces defining a first slot and first and second antenna traces defining a second slot;

the first and second antenna traces comprising a first edge emitting antenna, the second slot aligned with a first cutout defined by the substrate; and one of a transmitter and a receiver disposed over the first material and coupled to the first edge emitting antenna by the first and second circuit traces.

2. The communication device of claim 1 further comprising:

wherein the conductive layer further defines third and fourth circuit traces defining a third slot therebetween, and a second edge emitting antenna;

the other of the one of a transmitter and a receiver disposed over the first material and coupled to the second edge emitting antenna;

wherein the second edge emitting antenna comprises third and fourth spaced antenna traces defining a fourth slot in communication with the third slot, and the substrate defines a second cutout aligned with the fourth slot.

3. The communication device of claim 1 further comprising RF circuitry disposed on the first side of the substrate and coupled to the patterned conductive layer.

4. The communication device of claim 1 further comprising:

a second material characterized for high frequency devices positioned over a second side of the substrate;

a second conductive layer patterned on the second high frequency material to define a second antenna over the second portion and third and fourth traces defining a third slot therebetween over the first portion;

the other of the one of a transmitter and a receiver positioned on and in electrical contact with the second patterned conductive layer; and wherein the second antenna comprises third and fourth spaced antenna traces defining a fourth slot in communication with the third slot, and the substrate defines a second cutout on a side of the high frequency layer opposed to the third slot, the first and second antennas off set wherein the first and second cutouts are staggered.

5. The communication device of claim 4 wherein the first high frequency material defines a third cutout between the first slot and first cutout, and the second high frequency material defines a fourth cutout between the second slot and second cutout.

6. The communication device of claim 1 further comprising:

a second material characterized for high frequency devices positioned over second side of the substrate;

a second conductive layer patterned on the second high frequency material to define a second antenna over the second portion and third and fourth traces defining a third slot therebetween;

the other of the one of a transmitter and a receiver positioned on and in electrical contact with the second patterned conductive layer; and wherein the second antenna comprises third and fourth spaced antenna traces defining a fourth slot and in communication with the third slot, and the third slot being on a side of the second material opposed to the second slot.

7. The communication device of claim 6 wherein the first high frequency material defines a fifth slot between the first slot and first cutout, and the second high frequency material defines an sixth slot between the second slot and second cutout.

8. The communication device of claim 6 further comprising one or more isolation layers disposed within the substrate.

9. The communication device of claim 8 wherein the one or more isolation layers comprise patterned features.

10. A communication device including:

a substrate including first and second portions and characterized for low frequency devices;

a first material characterized for high frequency devices positioned over a first side of the substrate;

a first ground plane consisting of a conductive layer disposed between the first portion of the substrate and the material;

a conductive layer patterned on the material to define a first antenna over the second portion, and first and second traces defining a first slot therebetween over the first portion; and one of a transmitter and a receiver positioned on and in electrical contact with the patterned conductive layer;

wherein the first antenna comprises first and second spaced antenna traces defining a second slot in communication with the first slot, and the substrate defines a first cutout on a side of the material opposed to the first slot.

11. The communication device of claim 10 further comprising:

wherein the conductive layer further defines third and fourth circuit traces defining a third slot therebetween over the first portion, and a second antenna over the second portion;

the other of the one of a transmitter and a receiver positioned on and in electrical contact with the patterned conductive layer;

wherein the second antenna comprises third and fourth spaced antenna traces defining a fourth slot in communication with the third slot, and the substrate defines a second cutout on a side of the high frequency material opposed to the fourth slot.

12. The communication device of claim 10 further comprising:

a second material characterized for high frequency devices positioned over second side of the substrate;

a second ground plane comprising a second conductive material disposed between the first portion of the substrate and the second high frequency material;

a second conductive layer patterned on the second high frequency material to define a second antenna over the second portion and third and fourth traces defining a third slot therebetween over the first portion;

the other of the one of a transmitter and a receiver positioned on and in electrical contact with the second patterned conductive layer; and wherein the second antenna comprises third and fourth spaced antenna traces defining a fourth slot in communication with the third slot, and the substrate defines a second cutout on a side of the high frequency layer opposed to the third slot, the first and second antennas off set wherein the first and second cutouts are staggered.

13. The communication device of claim 12 wherein the first high frequency material defines a fifth slot between the first slot and first cutout, and the second high frequency material defines a sixth slot between the third slot and second cutout.

14. The communication device of claim 10 further comprising:

a second material characterized for high frequency devices positioned over second side of the substrate;

a second ground plane comprising a second conductive material disposed between the first portion of the substrate and the second high frequency material;

a second conductive layer patterned on the second high frequency material to define a second antenna over the second portion and third and fourth traces defining a third slot therebetween over the first portion;

the other of the one of a transmitter and a receiver positioned on and in electrical contact with the second patterned conductive layer; and wherein the second antenna comprises third and fourth spaced antenna traces defining a fourth slot in communication with the third slot, and the third slot on a side of the second material opposed to the first cutout.

15. A communication device comprising:

a substrate characterized for low frequency devices;

a first material characterized for high frequency devices positioned over a first side of the substrate;

transmitter circuitry disposed over the first material;

a first conductive layer patterned on the first material to define first traces and a first antenna, the first traces coupled between the first antenna and the transmitter circuitry;

a second material characterized for high frequency devices positioned over a second side of the substrate;

receiver circuitry disposed over the second material;

a second conductive layer patterned on the second material to define second traces and a second antenna, the second traces coupled between the second antenna and the receiver circuitry;

the first antenna defined by first and second antenna traces having a first slot therebetween, the second antenna defined by third and fourth antenna traces having a second slot therebetween; and one or more conductive layers disposed within the substrate.

16. The communication device of claim 15 wherein the one or more conductive layers comprise patterned features.

17. The communication device of claim 15 wherein the substrate defines a first cutout aligned with the first and second slots.

18. The communication device of claim 15 wherein the first cutout defined by the substrate comprises a second cutout aligned with the first slot and a third cutout aligned with the second slot, the first and second antenna being staggered on opposed sides of the substrate.

19. The communication device of claim 15 further comprising:

a first ground plane disposed between a second portion of the substrate and the first material; and a second ground plane disposed between the second portion of the substrate and the second material.

20. The communication device of claim 15 further comprising DC circuitry disposed on a portion of the substrate not underlying the first material and coupled to at least one of the first and second patterned conductive layers.

21. The communication device of claim 15 wherein the first layer defines a second cutout between the first slot and the first cutout, and the second layer defines a third cutout between the second slot and the first cutout.

* * * * *